US010502522B2

(12) United States Patent
Tanzini et al.

(10) Patent No.: US 10,502,522 B2
(45) Date of Patent: Dec. 10, 2019

(54) EXPANDABLE BATON WITH MAGNETIC RETENTION

(71) Applicant: Peacekeeper Products International LLC, Pomona, CA (US)

(72) Inventors: Philip J. Tanzini, Chino Hills, CA (US); Nicolas J. Tanzini, Chino Hills, CA (US)

(73) Assignee: PEACEKEEPER PRODUCTS INTERNATIONAL LLC, Pomona, CA (US)

( * ) Notice: Subject to any disclaimer, the term of this patent is extended or adjusted under 35 U.S.C. 154(b) by 68 days.

(21) Appl. No.: 15/934,597

(22) Filed: Mar. 23, 2018

(65) Prior Publication Data

US 2018/0274880 A1 Sep. 27, 2018

Related U.S. Application Data

(60) Provisional application No. 62/476,619, filed on Mar. 24, 2017.

(51) Int. Cl.
*F41B 15/02* (2006.01)
*F41B 15/00* (2006.01)

(52) U.S. Cl.
CPC ..... *F41B 15/022* (2013.01); *F41B 15/00* (2013.01); *F41B 15/02* (2013.01); *F41B 15/025* (2013.01); *F41B 15/027* (2013.01)

(58) Field of Classification Search
CPC ..... F41B 15/00; F41B 15/02; F41B 15/022; F41B 15/025; F41B 15/027
USPC ..... 463/47.2, 47.4, 47.7
See application file for complete search history.

(56) References Cited

U.S. PATENT DOCUMENTS

| | | | | |
|---|---|---|---|---|
| 5,568,922 | A | 10/1996 | Siddle | |
| 5,690,552 | A | 11/1997 | Siddle | |
| 6,056,643 | A | 5/2000 | Wilmoth, III | |
| 6,791,816 | B2 * | 9/2004 | Stethem | F21V 33/0076 231/7 |
| 7,488,255 | B2 * | 2/2009 | Labes | F41B 15/027 135/75 |
| 7,625,289 | B1 * | 12/2009 | Fagliarone | A63B 69/004 362/102 |
| D627,852 | S * | 11/2010 | Yang-Fu | D22/117 |
| D630,292 | S * | 1/2011 | Yang-Fu | D22/117 |

(Continued)

*Primary Examiner* — William H McCulloch, Jr.
(74) *Attorney, Agent, or Firm* — Womble Bond Dickinson (US) LLP

(57) ABSTRACT

An expandable baton including a handle tube having a proximal end, a distal end, and a channel extending between the proximal end and the distal end. The expandable baton further includes a striking rod dimensioned to slide within the channel and having a retention end. In addition, the expandable baton further includes an end cap attached to the proximal end of the handle tube. The end cap includes a well chamber with a retention magnet that is configured to attract the striking rod. The retention magnet retains the collapsed position by attracting the striking rod. The well chamber also has a collar that is separated from the retention magnet by a determined distance, such that there is a separation between the collar and the retention magnet. The collar is configured to abut the retention end of the striking rod while the expandable baton is in a collapsed position.

21 Claims, 7 Drawing Sheets

(56) References Cited

U.S. PATENT DOCUMENTS 8,568,242 B2 * 10/2013 Milligan ..... F41B 15/025 463/47.7
8,721,459 B2 * 5/2014 Pelkey ..... F41B 15/027 463/47.7
8,771,085 B1 * 7/2014 Clyde ..... G06F 1/1696 361/679.01
8,794,782 B2 8/2014 Bushee et al.
8,956,235 B2 * 2/2015 Cheng ..... F41B 15/027 463/47.2
9,671,192 B2 * 6/2017 Cheng ..... F41B 15/00
D811,515 S * 2/2018 Parise ..... D22/117
D829,298 S * 9/2018 Parise ..... D22/117
10,184,650 B1 * 1/2019 Tanzini ..... F21V 23/0407
2002/0155894 A1 * 10/2002 Evenson ..... F41B 15/02 463/47.2
2002/0187838 A1 * 12/2002 Cheng ..... F41B 15/027 463/47.6
2005/0083679 A1 * 4/2005 Macierowski ..... F41B 15/027 362/102
2008/0225519 A1 9/2008 Uke
2012/0122593 A1 * 5/2012 Gross ..... F41B 15/06 463/47.4
2013/0176711 A1 * 7/2013 Bushee ..... F21V 33/0076 362/102
2014/0256452 A1 * 9/2014 Cheng ..... F41B 15/027 463/47.7
2014/0256453 A1 * 9/2014 Pelkey ..... F41B 15/027 463/47.7
2014/0334131 A1 * 11/2014 Bushee ..... F21V 33/0076 362/102
2015/0038240 A1 * 2/2015 Parsons ..... F41B 15/027 463/47.7
2016/0169616 A1 * 6/2016 Cheng ..... F41B 15/00 463/47.7
2016/0298939 A1 * 10/2016 Kuo ..... F41H 9/10
2018/0274880 A1 * 9/2018 Tanzini ..... F41B 15/022

* cited by examiner

EXPANDABLE BATON WITH MAGNETIC RETENTION

CROSS-REFERENCE TO RELATED APPLICATION

The application is a non-provisional application of U.S. Provisional Patent Application No. 62/476,619, filed Mar. 24, 2017 and incorporated herein by reference.

FIELD

An embodiment of the invention relates to an expandable baton that uses a magnet to retain a collapsed position while the expandable baton is retracted. Other embodiments are also described.

BACKGROUND

For many years, the law enforcement industry has utilized a variety of less than lethal weapons. The need to stop a violent threat without the necessity of fatally injuring a suspect with a firearm is always desirable.

Police batons have been an effective less lethal option that has been used in the law enforcement industry for many decades. Since their inception, batons have consisted of a club of less than arm's length made of wood, rubber, steel, aluminum, and a variety of other composites. This type of baton, called a "fixed baton", may have a relatively large diameter and be 18-36 inches in length. These fixed batons have several drawbacks. For example, as batons are typically worn as part of a police officer's duty belt, police officers may have reduced maneuverability while the baton is worn on the belt, since the batons may swing back and forth while the police officer is moving. Furthermore, as a matter of convenience, police officers may be forced to constantly reposition the fixed baton based on whether they are standing or in a seated position. For instance, a police officer may need to constantly remove the fixed baton while seating themselves in a police cruiser. In which case, the baton may be accidentally left within the cruiser if the officer is forced to make a quick decision to exit the vehicle.

In response to the above-mentioned drawbacks, the law enforcement industry developed an expandable baton that was capable of retracting to a collapsed position. A typical expandable baton is composed of a cylindrical outer shaft containing telescoping inner shafts (typically two or three), all of which are hollow. The innermost shaft (e.g., the striking tube) would have the smallest diameter (of the other shafts) and include a striking section (e.g., a tip) that would be used to concentrate the force of a blow on a target. In order to expand the baton, a user would hold the outer shaft with one hand and pull on the striking section in order to fully expand out the baton. When the user wished to collapse the baton, the user would compress the inner shafts within the outer shaft, such that the inner shafts were primarily contained within the outer shaft. The inner shafts would retain their position within the outer shaft through the use of a retention clip (or retention wire) that was affixed to a cap that is attached to a back end of the outer shaft of the baton. Once the inner shafts are collapsed, the retention clip becomes inserted into the hollow portion of the striking tube and subsequently retains the baton in the collapsed position. With a collapsible design, the baton can be compressed to a length of between 8-10 inches, depending on the overall length of the baton, which is more manageable for the police officer.

SUMMARY

Although a conventional expandable baton solves many problems encountered by the fixed batons, the expandable batons have drawbacks as well. For example, most expandable batons have a considerable amount of their weight concentrated at the grip, while the lightest part of the baton is the striking tube, since it is the thinnest part of the baton. As such, the baton may deliver less forceful blows than the fixed baton. In addition, with regular use (e.g., expanding and collapsing the baton), the retention clip (or wire) may become warn, and not maintain the baton in a collapsed position. In response, an officer may need to manipulate the retention clip (e.g., pull the sides of the retention clip apart) in order to make the baton firmer. If too firm, however, the officer may have to squeeze the sides of the retention clip together to make the baton easier to open, which adds further wear and stress to the retention clip. In either case, having to constantly adjust the retention clip (or even replace it all together) is not a practical solution.

The instant invention is directed to an expandable baton with a retention magnet that maintains the baton in a collapsed position. In one embodiment, the retention magnet is located in a retention structure within an end cap of the expandable baton and is used to maintain the collapsed position of the baton. Specifically, the retention magnet maintains the collapsed position by attracting the end of a solid striking rod (e.g., made of ferrous metal) towards the retention magnet through the use of its magnetic force. With the incorporation of a solid striking rod (rather than a hollow striking tube), the expandable baton may have more durability and striking power. For instance, a solid striking rod is less malleable than batons with striking tubes due to its solid nature. Furthermore, as the solid striking rod is heavier than striking tubes of similar size (due to its increased density), the solid striking rod is more effective at neutralizing intended targets. With a heavier striking rod, more kinetic energy is directed towards an intended target, potentially reducing the need for continuous usage, thereby increasing its effectiveness.

The retention structure ensures that the magnet is not damaged while a user retracts the expandable baton. Specifically, in one embodiment, the retention structure includes a well chamber that (1) holds the retention magnet and (2) has a shoulder (or collar) that is elevated above and separated from the retention magnet by a particular (or otherwise predetermined) distance. In order for a user to retract the expandable baton, in some embodiments, it requires a sudden force on the striking rod, towards the end cap of the baton, to fully collapse the baton. The collar ensures that the solid striking rod does not make contact with the retention magnet, while the baton is collapsing. Maintaining this distance between the striking rod and retention magnet helps to reduce the potential for baton failure in the field. For example, if the retention magnet were to make contact with the solid striking rod each time it collapses, the rod may damage the retention magnet, rendering it less effective in retaining the collapsed position of the baton.

In addition to increasing performance and durability of the expandable baton, the solid striking rod allows for the use of a striking tip that envelopes the striking rod. For example, in one embodiment, rather than securing the striking tip into the striking rod, the striking tip is fastened around an outer surface of the striking rod. In order to secure the striking tip onto the striking rod, the striking tip may have an internal (or female) thread located within a cavity of the striking tip and the solid striking rod may have a complementary external (or male) thread located at its end (e.g., around the outer surface). The striking tip is then tightened (e.g., screwed) onto the solid striking rod.

More specifically, in one embodiment, the expandable baton includes a handle tube having a proximal end, a distal end, and a channel extending between the proximal end and the distal end. In one embodiment, the handle tube is between 1.0625 inches and 1.1875 inches in diameter. The expandable baton further includes a striking rod dimensioned to slide within the channel and having a retention end. In addition, the expandable baton further includes an end cap attached to the proximal end of the handle tube. The end cap includes a well chamber with a retention magnet that is configured to attract the striking rod. The retention magnet retains the collapsed position by attracting the striking rod using its magnetic force. The well chamber also has a collar that is separated from the retention magnet by a determined distance, such that there is a separation between the collar and the retention magnet. The collar is configured to abut the retention end of the striking rod while the expandable baton is in a collapsed position.

In order to protect the retention magnet from being damaged from the striking rod, the well chamber includes a first diameter and the retention end of the striking rod includes a second diameter that is more than the first diameter, such that while the striking rod is within the channel, the striking rod can not enter the well chamber. In addition, the predetermined distance in which the collar is separated from the retention magnet is between 0.005 inches and 0.08 inches. Although the magnet is separated from the rod, the magnet attracts the rod by having a pull force measurement of between at least one of 14-18 lbs. and 19-22 lbs.

In one embodiment, the channel of the handle tube is a first channel and the expandable baton also includes a middle tube that is dimensioned to slide within the first channel of the handle tube and configured to house the striking rod in a second channel of the middle tube. In another embodiment, the collar is a first collar and the end cap further includes a second collar. The proximal end is a first proximal end and the middle tube further includes a second proximal end that is configured to abut the second collar when the striking rod is within the second channel. In another embodiment, the second collar has a tapering hollow portion that tapers from the second collar towards the first collar, such that the first collar has a first diameter and the second collar has a second diameter that is larger than the first diameter.

In one embodiment, the striking rod is a solid striking rod that is composed of a metallic alloy comprising a ferrous metal. In another embodiment, the baton further includes a striking tip having an internal thread, where the striking tip is configured to fasten to a striking end including an external thread of the solid striking rod through tightening the internal thread of the striking tip onto the external thread of the solid striking rod.

In another embodiment, the expandable baton includes a handle tube having a first end, a second end, and a channel extending between the first end and the second end. The expandable baton also includes a middle tube having a hollow interior, a first portion positioned within the channel of the handle tube and a second portion extending from the second end of the handle tube. In addition, the expandable baton includes a solid striking rod having a first portion positioned within the hollow interior of the middle tube and a second portion extending from the second portion of the middle tube, the second portion of the striking rod having an exterior thread along its outer surface. The expandable baton also includes a striking tip having an interior thread complementary to that of the exterior thread of the striking rod, wherein such that the striking tip attaches to and envelopes the second portion of the striking rod. The expandable baton also includes an end cap attached to the first end of the handle tube, wherein the end cap includes a retention structure that is configured to retain the middle tube and the solid striking rod within the channel of the handle tube when the expandable baton is in a collapsed position.

In another embodiment, the striking tip includes a first end having the interior thread and a second end, opposite from the first end, having a flat surface. The first end has a first diameter and the second end has a second diameter that is larger than the first end. In another embodiment, the first end of the striking tip smoothly transitions to the second end of the striking tip, such that the striking tip does not include any sharp edges.

In another embodiment, the invention, the expandable baton includes a handle tube with a proximal end, a distal end, and a first channel extending between the proximal end and the distal end. The expandable baton also includes a middle tube having a hollow interior, a first portion within the channel and a second portion extending from the distal end of the handle tube. The expandable baton further includes a solid striking rod, wherein at least a portion of the solid striking rod is within the hollow interior of the middle tube. In addition, the expandable baton also includes an end cap that is attached to the proximal end of the handle tube, wherein the end cap includes a retention structure that is configured to retain a collapsed position of the expandable baton, such that there is a separation between the retention structure and the solid striking rod.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, structures and techniques have not been shown in detail so as not to obscure the understanding of this description. Furthermore, unless the meaning is clearly to the contrary, all ranges set forth herein are deemed to be inclusive of the endpoints. In addition, the terms "over", "to", and "on" as used herein may refer to a relative position of one feature with respect to other features. One feature "over" or "on" another feature or bonded "to" another feature may be directly in contact with the other feature or may have one or more intervening layers. In addition, the use of relative terms throughout the description, such as "top", "above or "upper" and "bottom", "under" or "lower" may denote a relative position or direction. For example, a "top edge", "top end" or "top side" may be directed in a first axial direction and a "bottom edge", "bottom end" or "bottom side" may be directed in a second direction opposite to the first axial direction.

Figure 1:
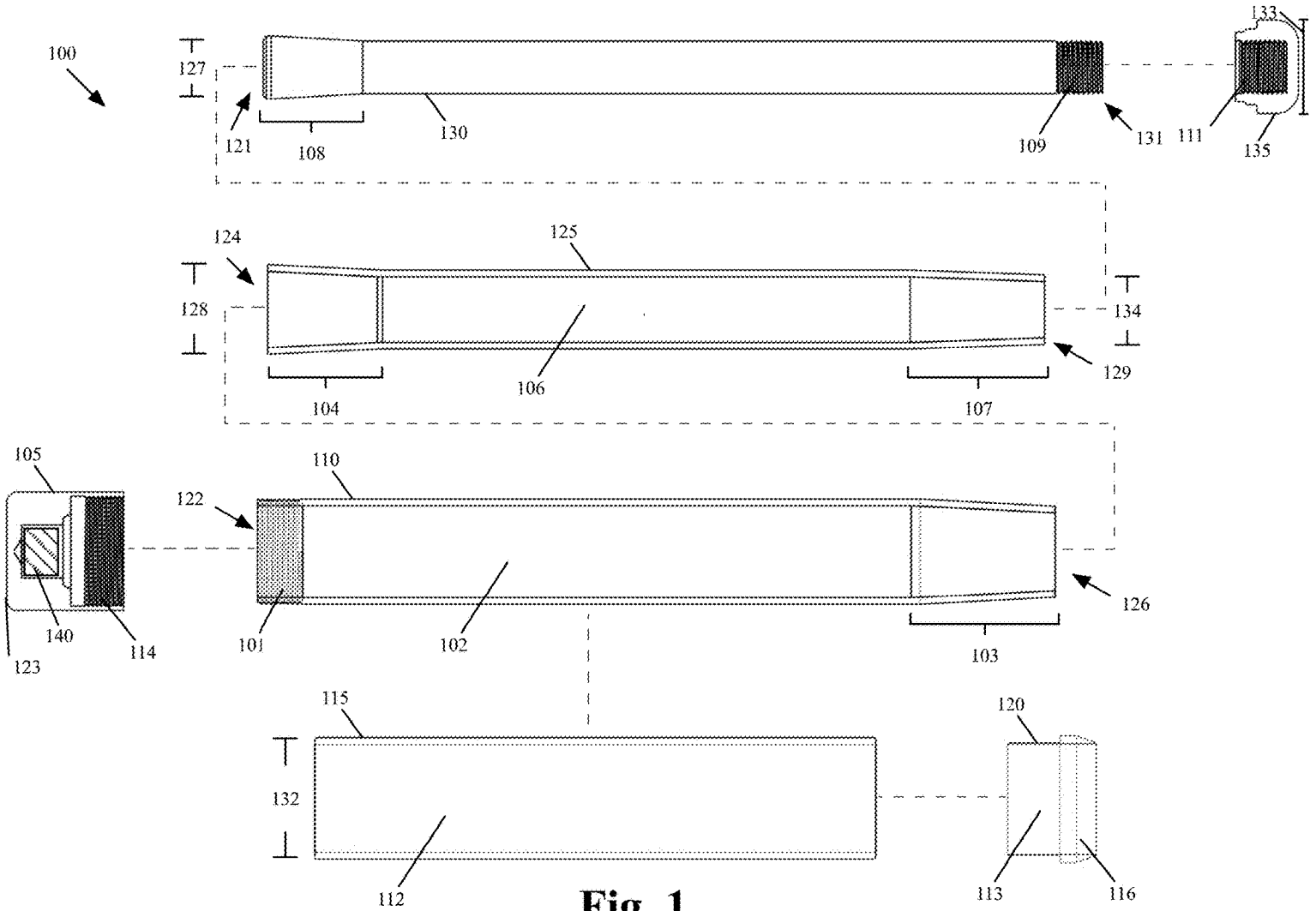
FIG. 1 illustrates an exploded view of one embodiment of an expandable baton.

FIG. 1 illustrates an exploded view of one embodiment of an expandable baton 100. The baton 100 includes an end cap 105, a handle tube 110, a grip 115, a grip ring 120, a middle tube 125, a solid striking rod 130, and a striking tip 135. The handle tube 110 includes a hollow channel 102 (e.g., a first channel), a threaded portion 101 at one end 122 (e.g., a first end or a proximal end) of the handle tube 110, and a tapered portion 103 at an opposite end 126 (e.g., a second end or a distal end). The tapered portion 103 is tapered inward, towards a center longitudinal axis of the handle tube 110, such that a diameter of the tapered portion 103 decreases as it moves away from the handle tube 110. The largest diameter of the handle tube is between 1.0625 inches and 1.1875 inches in diameter, for example, from 1.085 inches to 1.105 inches, or from 1.11 inches to 1.14 inches. The hollow channel 102 houses the middle tube 125 that is of a lesser diameter than the hollow channel 102. The middle tube 125 includes a hollow channel 106 (e.g., a second channel), a tapered portion 104 (e.g., a first portion) at one end 124 (e.g., a second proximal end) of the middle tube 125, and another tapered portion 107 (e.g., a second portion) at an opposite end 129. The tapered portion 104 is tapered away from a center longitudinal axis of the middle tube 125, such that a diameter of the tapered portion 104 increases as it moves away from the middle tube 125 and towards the end 124 that has a diameter 128. In one embodiment, the diameter 128 is the largest diameter of the middle tube 125. The tapered portion 107 is tapered inward, towards the center longitudinal axis of the middle tube 125, such that a diameter of the tapered portion 107 decreases as it moves away from the middle tube 125 and towards the end 129 that has a diameter 134. In one embodiment, the diameter 134 is the smallest diameter of the middle tube 125. The hollow channel 106 houses a solid striking rod 130 that is of a lesser diameter than the hollow channel 106. The solid striking rod 130 includes a tapered portion 108 (e.g., a first portion) at one end 121 (e.g., a proximal end or a retention end) of the striking rod 130 and a threaded portion 109 (e.g., a second portion) at an opposite end 131 of the striking rod 130. The tapered portion 108 is tapered away from a center longitudinal axis of the striking rod 130, such that a diameter of the tapered portion 108 increases as it moves away from the solid striking rod 130 and towards the end 121 that has a diameter 127 (e.g., a second diameter). In one embodiment, the diameter 127 is the largest diameter of the striking rod 130. The threaded portion 109 fastens the striking tip 135 to the striking rod 130 by tightening a threaded portion 111 of the striking tip 135 onto the threaded portion 109. More about the relationship between the solid striking rod 130 and the striking tip 135 are further described in FIG. 7. As such, the middle tube 125 and the striking rod 130 are nested within the handle tube 110 and are designed to telescopically extend out from the handle tube 110, away from (e.g., distal from) a user holding the baton 100 at the handle tube 110.

As previously discussed, the baton 100 is an impact weapon (used to strike objects) therefore the components of the baton 100 must be able to withstand repeated use, while at the same time maximizing an amount of kinetic energy delivered towards a target. In order to create a durable baton 100, the above-mentioned components may be made of hardened materials. For example, the handle tube 110 and the middle tube 125, which are both hollow, may be made of a composite metal material, such as steel. The striking rod 130, on the other hand, may be made of a solid piece of composite metal material, such as a ferrous metal. In one embodiment, where the striking rod 130 is solid, it may be made of a specific metal alloy with a sufficient carbon content in order to set a specific hardness of the rod. It should be understood that a solid striking rod 130, creates a more durable baton 100, than batons with a hollow striking tube of equivalent diameters. For instance, batons with hollow striking tubes may bend as a result of either repeated use or striking a hard object. A solid striking rod, on the other hand, is less malleable due to its increased density. Furthermore, since a solid striking rod is denser than a hollow striking rod, it is also heavier. As a result, with more weight towards the end of the baton 100, a user is able to deliver more striking power towards a target, thereby reducing an amount of required effort. Moreover, since the striking tip 135 is the primary portion of the baton 100 that will engage a target, the striking tip 135 must be composed of a strong material. For instance, the striking tip 135 may be composed of any hardened composite metal material, such as hardened steel. In one embodiment, at least one of the handle tube 110, the middle tube 125, and striking rod 130 is "machined" or "milled" from a single piece of metal material.

Figure 2:
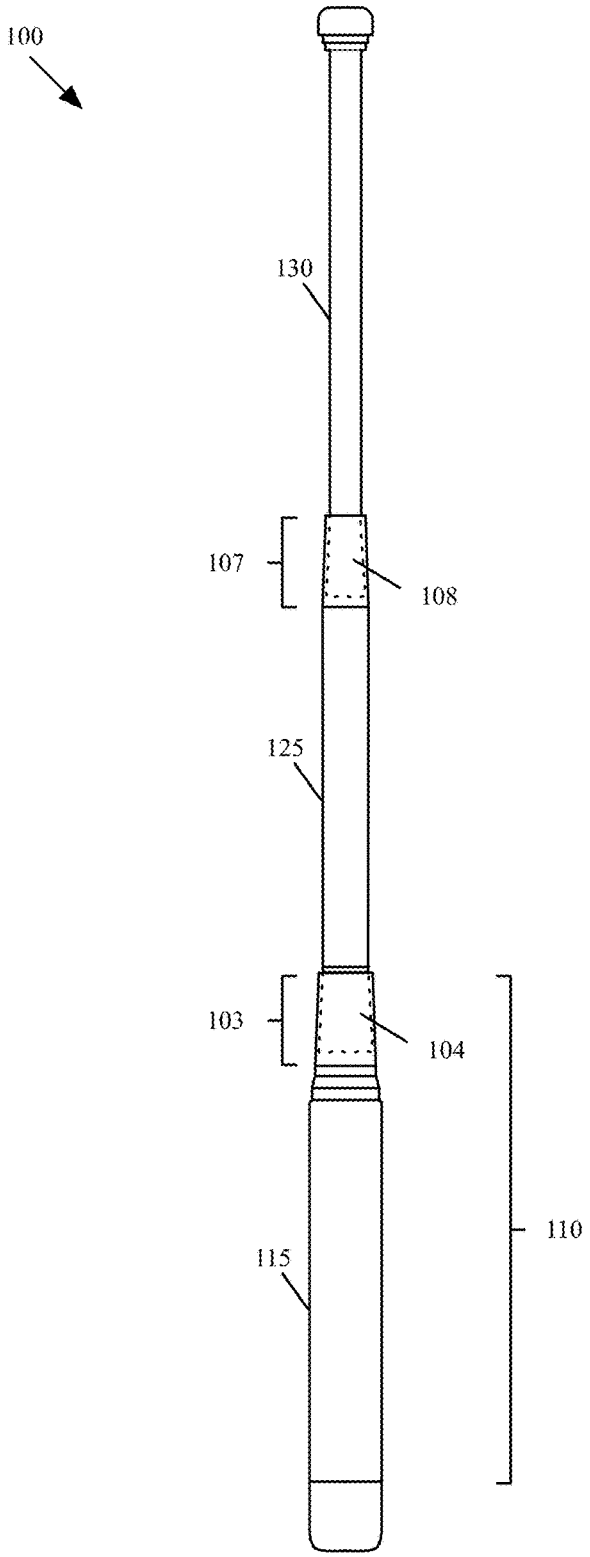
FIG. 2 illustrates a view of an assembled baton of FIG. 1 in an expanded position.

In order to maintain an extended position, the baton 100 uses a "friction-lock" design, in which a tapered portion of one tube (or rod) wedges into an opposite tapered portion of another tube. This wedging creates friction between tapered portions, thereby keeping the tube/rod in place. FIG. 2 illustrates such an example. FIG. 2 shows an assembled baton 100 that is in an extended position that represents the most at which the baton 100 can telescopically extend. This position is maintained by wedging the tapered portions of the tubes (and rod) into opposite tapered portions of another rod. For example, in one embodiment, in order for the middle tube 125 to maintain an extended position, the tapered portion 104 of the middle tube 125 is wedged within tapered portion 103 of the handle tube 110. In addition, in order for the striking rod 130 to maintain its extended position, tapered portion 108 of striking rod 130 is wedged into the tapered portion 107 of the middle tube 125. Once in the extended position, a user is able to wield the baton without fear of the baton collapsing while in use.

Returning to FIG. 1, as described above, the baton 100 includes a grip 115. The grip 115 includes a hollow channel 112 that houses the handle tube 110. The grip 115 is a portion of the baton 100 in which a user's hand grasps while using the baton 100. The grip 115 may be composed of any material, such as wood, rubber, plastic, nylon, or any composite metal material. In one embodiment, the grip 115 may be textured, such that the baton 100 will not easily slip from the user's hand while being used. In another embodiment, a diameter 132 of the grip 115 is between 1 inch and 1.25 inches in diameter, for example from 1.1 inches to 1.21 inches, or from 1.15 inches to 1.2 inches. In one embodiment, the diameter 132 of the grip 115 is 1.125 inches. Although the grip 115 is illustrated as being separate from the handle tube 110, in one embodiment, the grip 115 is actually part of the handle tube 110 (e.g., one machined piece). The grip ring 120 includes a hollow channel 113 and a flared portion 116. The grip ring 120 keeps the grip 115 in position by preventing the grip 115 from moving forward (e.g., towards a distal end of the baton 100). The flared portion 116 accomplishes this by pushing up against the grip 115, while the handle tube 110 is housed within both the grip ring 120 and the grip 115. In addition, the grip ring 120 allows for a smooth transition between the grip 115 and handle tube 110, preventing exposure of the grip's 115 corners. This smooth transition reduces the possibility of something (e.g., clothing) getting caught on the baton 100 while in use and allows the baton to efficiently enter a holster (on a belt worn by a police officer) when the baton 100 is holstered in an open (e.g., expanded) or closed (e.g., retracted) position. The grip ring 120 may be composed of any material, such as wood, rubber, plastic, nylon, or any composite metal material.

The end cap 105 is designed to keep the middle tube 125 and solid striking rod 130 from extending out of the handle tube 110 while the baton 100 is in a "collapsed position", which represents a compression of the middle tube 125 and striking rod 130 into the handle tube 110. The end cap 105 is attached to the handle tube 110 through use of the threaded portion 114 that fastens the end cap 105 to the handle tube 110 by tightening the threaded portion 114 of the end cap 105 onto the threaded portion 101 of the handle tube. Along with keeping the components of the collapsed baton 100 from extending out, the end cap is also designed to retain the collapsed position of the baton 100. This is achieved through the use of the retention magnet 140 that magnetically attracts the solid striking rod 130, thereby not allowing the rod (as well as the middle tube 125) to move distally on its own (e.g., through gravity or other external forces). The middle tube 125, although not retained (e.g., attracted) directly by the retention magnet 140, is retained in its position through the use of the striking rod 130 and the striking tip 135. For instance, since a diameter 133 of the striking tip 135 is larger than a diameter 134 of the end 129 of the middle tube 125, the striking tip 135 pushes on the end 129 of the middle tube 125, such that the middle tube 125 is pushed towards and into the end cap 105 and the handle tube 110. In one embodiment, however, the retention magnet retains, through magnetic attraction, both the solid striking rod 130 and the middle tube 125. In order to attract the solid striking rod 130, the retention magnet 140 must be of sufficient strength to hold it into position. In one embodiment, the retention magnet has a surface field between 5500 Gauss and 6500 Gauss, for example from 5600 Gauss to 6300 Gauss, or from 5900 Gauss to 6000 Gauss. In one embodiment, the surface field is approximately 6150 Gauss. In another embodiment, the retention magnet has pull force measurement of between 14-18 lbs., for example, from 14.5 lbs. to 17.5 lbs., or 15.5 lbs. to 16 lbs. In one embodiment, the pull force measurement is approximately 16.6 lbs. In another embodiment, the pull force can include a different range of values. For instance, the pull force measurement may be between 19 lbs. to 22 lbs., for example, from 19.5 lbs. to 21 lbs. In one embodiment, the pull force measurement is approximately 20 lbs. While in another embodiment, the pull force of the retention magnet 140 is just strong enough to counter the effects of gravity and other external forces (e.g., forces caused while a user is moving about) on the baton 100. Although strong enough to retain the collapsed position, the retention magnet 140 is also designed to allow a user to pull the striking rod 130 away from the retention magnet 140 in order to open (or expand) the baton 100. For example, a user may grasp the grip 115 with one hand and pull on the striking tip 135 with another hand in order to expand the baton 100. In another embodiment, a user is able to open the baton 100 through a whipping motion (e.g., holding the baton 100 by the grip 115 and flicking the baton 100 with a sudden motion).

Figure 3:
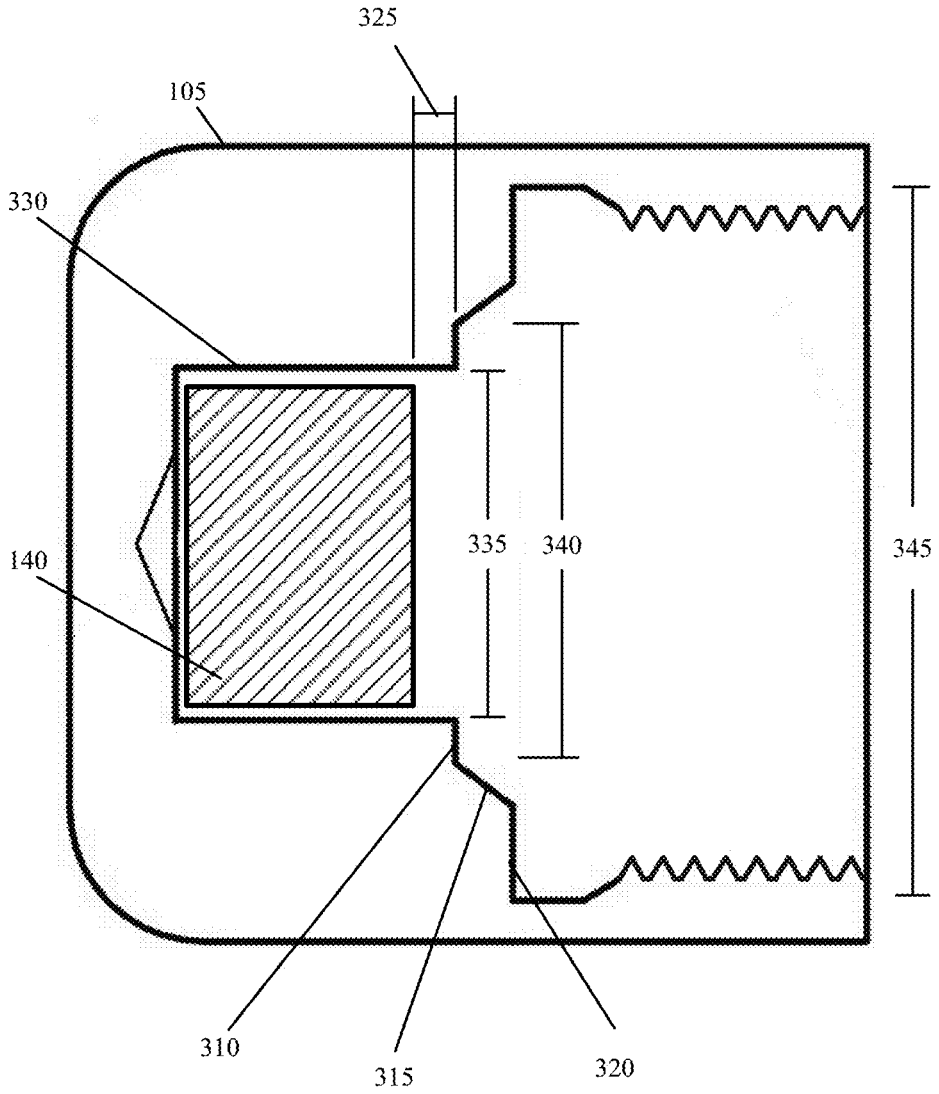
FIG. 3 illustrates a schematic cross-sectional view of the end cap of the expandable baton of FIG. 1.

FIG. 3 illustrates a schematic cross-sectional view of the end cap 105 of the baton 100 described in FIG. 1. In particular, from this view, it can be seen that the end cap 105 includes (e.g., a retention structure that has) a well chamber 330, first collar 310, second collar 320, and tapered portion 315 that is between the first collar 310 and the second collar 320. Each (or at least a portion) of the characteristics of the end cap 105 may be machined, or otherwise formed within a material of the end cap 105. In which case, the end cap 105 may be composed of any hardened material, such as a lightweight aluminum, steel, or any other composite metal or plastic material. In one embodiment, the well chamber 330 is for holding the retention magnet 140 in place. Although shown as having space between the retention magnet 140 and the walls of the well chamber 330, in some embodiments the retention magnet 140 is press fitted into the well chamber 330, leaving little to no room and thereby preventing the magnet from moving within the chamber. In one embodiment, the retention magnet 140 is permanently attached within the well chamber 330 with an adhesive. Along with holding the retention magnet in place, the well chamber 330 is designed such that there is a distance 325 between the retention magnet 140 and the first collar 310. This distance 325 allows for a separation between the retention magnet 140 and the first collar 310. The distance 325 may be between 0.005 inches and 0.08 inches, for example, from 0.01 inches to 0.07 inches, or from 0.04 inches to 0.06 inches. In one embodiment, the distance 325 is approximately 0.025 inches. However, in another embodiment, the distance 325 may be based on the properties of the magnet 140 (e.g., its pull force, size, shape, composite) and/or properties of the solid striking rod 130 (e.g., a surface area of the tapered distal portion 108, a composite of the rod, the size and shape of the rod). In one embodiment, the space between the retention magnet 140 and the first collar 310, created by the distance 325 may be left empty (e.g., air), or may be filled with a material (e.g., rubber).

The first collar 310 and the distance 325 between the retention magnet 140 and the first collar 110 are for protecting the retention magnet and maintaining a collapsed position of the baton 100. Specifically, the first collar 310 is for stopping the solid striking rod 130 as it is being closed and separating striking rod 130 at distance 325 from retention magnet 140 so that as the solid striking rod 130 does not come into contact with the retention magnet 140. For instance, if the baton 100 is in an expanded position, and using a friction-lock design to remain open, a sufficient amount of force may be required to close the baton 100 (e.g., striking the strike tip 135 on the ground). Without the separation 325, the solid striking rod 130 may hit and damage the retention magnet 140 while a user collapses the baton 100. With the magnet damaged, its magnetic properties may be reduced, thereby rendering it unable to retain a collapsed position of the baton 100. Therefore, the first collar 310, separated from the retention magnet 140 by the distance 325, protects the retention magnet 140 while the user retracts the baton 100 into the collapsed position. Furthermore, in order to ensure that the solid striking rod 140 does not come into contact with the retention magnet 140, in one embodiment, the well chamber 330 has a diameter 335 (e.g., a first diameter) that is smaller than the diameter 127 of the end 121 of the striking rod 130. This adds additional protection to the magnet 140 by ensuring that the striking rod 140 cannot enter the well chamber 330.

In addition to stopping the solid striking rod 130, the first collar 310 may also help maintain the collapsed position of the baton 100. For example, the first collar 310 may also hold the solid striking rod 130, while the retention magnet 140 attracts the rod in order to maintain the collapsed position. Specifically, as the retention magnet 140 attracts (or pulls on) the solid striking rod 130 using its magnetic force, the first collar 310, which is positioned between the retention magnet 140 and the solid striking rod 130, pushes back onto the solid striking rod 130, keeping it in position. Along with using the magnetic force of the magnet to keep the solid striking rod in position, the collar 310 may be designed, with a diameter 340 that is slightly larger than the diameter 127 of the end 121 of the solid striking rod 130. This ensures that the rod 130 sits perfectly on the first collar 310. In one embodiment, the diameter 340 is just large enough to fit the striking rod 130, ensuring that it does not move about while in the baton 100 is in the collapsed position.

The tapered portion 315 may help to ensure that the solid striking rod 130 slides into the first collar 310, while the baton 100 is being compressed and stays seated on the first collar 310. The second collar 320 may hold the middle tube 125, while the baton 100 is in a collapsed position. In particular, since the middle tube 125 has a larger diameter 128 than the striking rod 130, the striking rod 130 rests on the first collar 310, which has a smaller diameter 340 (e.g., a first diameter) than a diameter 345 (e.g., a second diameter) of the second collar 320, and the middle tube rests on the second collar 320. The second collar 320 is elevated from the first collar 310 to ensure that the solid striking rod 130 falls into the first collar 310, such that it is attracted by the retention magnet 140. In one embodiment, rather than having two collars, the end cap 105 has a single collar in which both the middle tube 125 and solid striking rod 125 rest. While, in another embodiment, the first collar 310 may be elevated higher than the second collar 320.

Figure 4A:
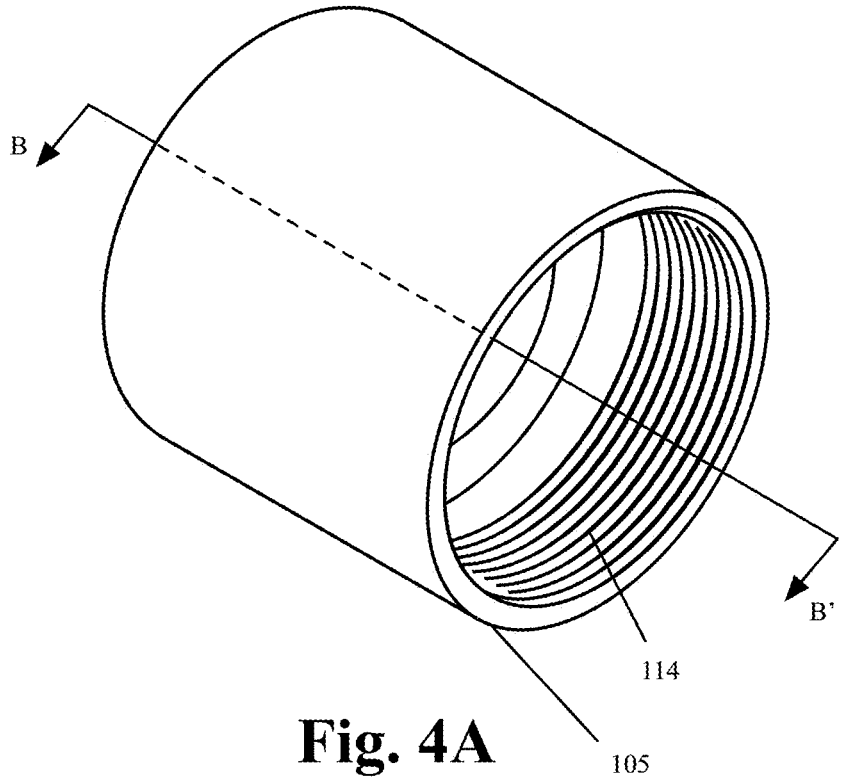
FIG. 4A illustrates a side perspective view of the end cap of FIG. 1 along line B-B'.
Figure 4B:
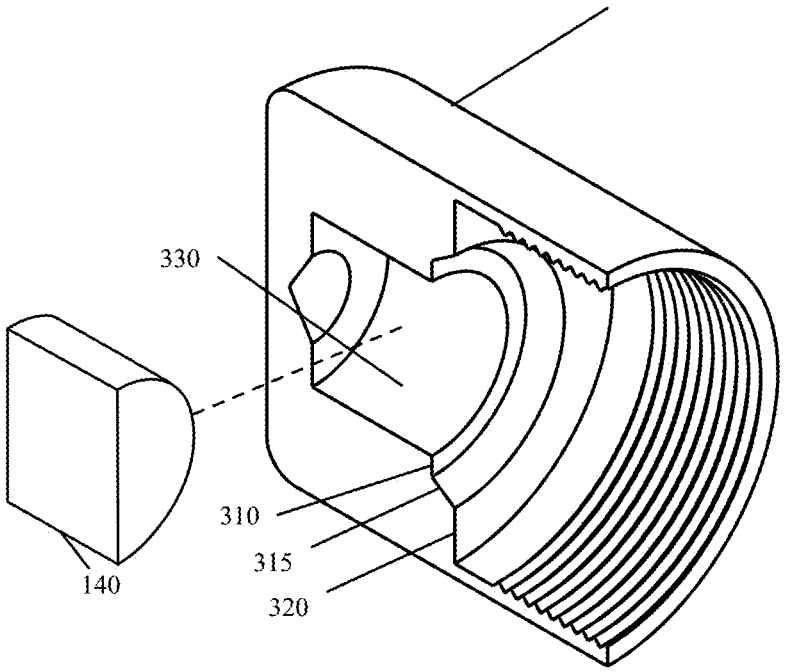
FIG. 4B illustrates a bisection of the side perspective view of the end cap of FIG. 1.

FIG. 4A illustrates a side perspective view of the end cap 105 of baton 100 of FIG. 1 along line B-B'. From this view, aspects of the end cap 105 can be seen in more detail. For instance, as shown by the side perspective view of FIG. 4A, the end cap 105 has a substantially tubular or cylindrical shape extending from the threaded portion 114 to a bottom 123 of the end cap 105. In this example, the end cap 105 is smooth with a flat bottom. In other embodiments, the design of the end cap 105 may be different. For example, in one embodiment, rather than having a flat bottom, the end cap 105 may include a conical shape, tapering from the edges of the end cap 105 and creating a point at the end. This type of design may enable a user to focus an impact force (using the end cap 105 rather than the striking tip 135) at a particular pressure point. This may be most effective when a user is unable to fully extend the baton 100 (e.g., in closed quarters). FIG. 4B illustrates a bisection of the side perspective view that shows additional detail regarding the inner structure of the end cap 105. For instance, this view shows that the first collar 310 and the second collar 320 have hollow openings, which allows the retention magnet 140 to be press fitted into the wall chamber 330. This view also illustrates that the well chamber 330 has a cylindrical shape. In other embodiments, however, the well chamber 330 may be a different shape, such as a conical shape. In which case, the well chamber 330 would taper inward and away from a distal end of the well chamber 330. In other embodiments, the well chamber 330 may be any shape complementary to that of the retention magnet 140. For example, the retention magnet 140 may be the same shape as the well chamber 330, in order for the retention magnet 140 to fit within the chamber.

Figure 5:
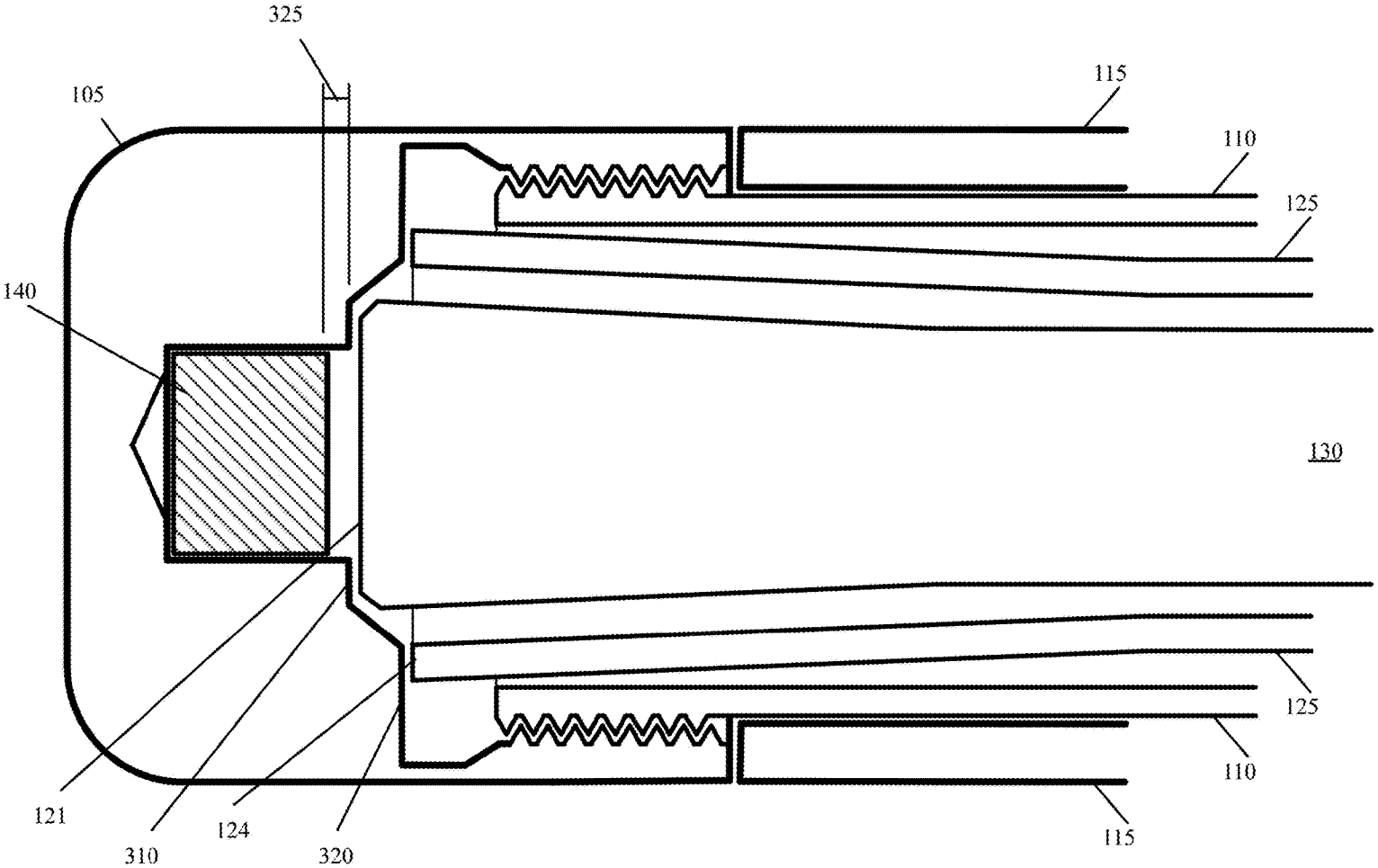
FIG. 5 illustrates a schematic cross-sectional view of the end cap while the expandable baton is in a collapsed position.

FIG. 5 illustrates a schematic cross sectional view of the end cap 105 while the assembled baton 100 is in a collapsed position. From this view it can be seen that end 121 of the solid striking rod 130 and end 124 of the middle tube 125 slide into the end cap 105, such that the baton 100 shrinks to a reduced size. For instance, FIG. 5 illustrates that while the baton 100 is in the collapsed position, the end 124 of the middle tube 125 rests on (or abuts) the second collar 320 and the end 121 of the solid striking rod 130 rests on (or abuts) the first collar 310. This view also illustrates that the solid striking tube 130 is aligned with the retention magnet 140. In one embodiment, along with retaining the collapsed position of the baton 100, the attraction of the retention magnet 140 aligns the solid striking rod 130 along a center longitudinal axis of the retention magnet 140. This alignment ensures that the solid striking rod 130 is seated within the first collar 310 in order to avoid shifting while the baton 100 is in the collapsed position.

Figure 6:
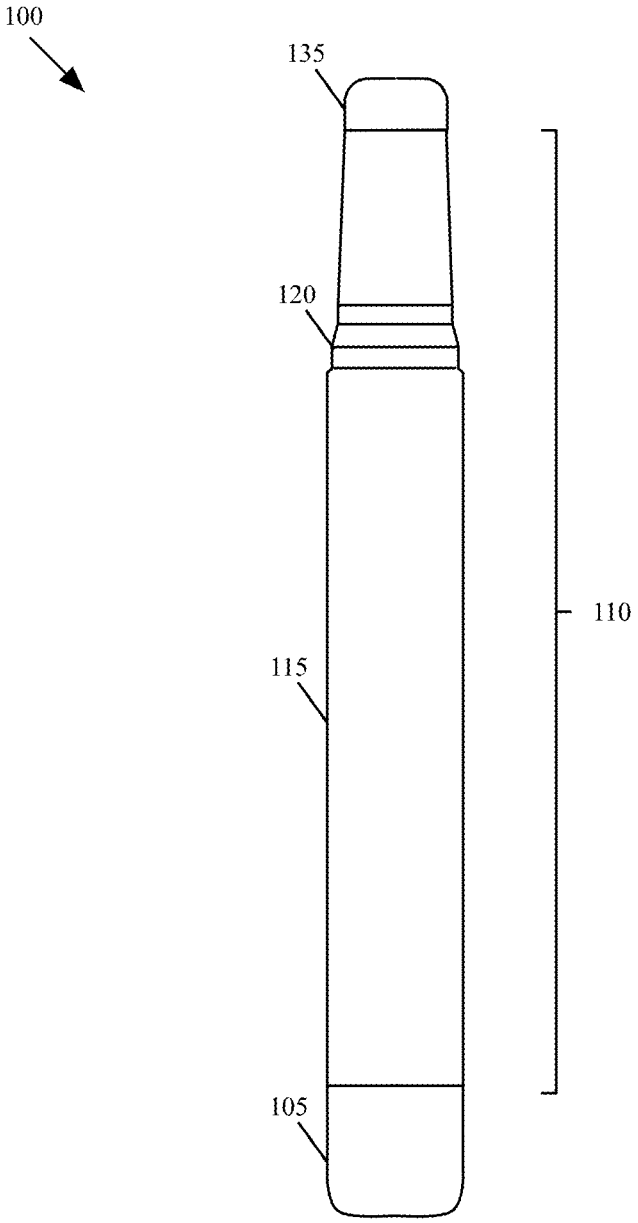
FIG. 6 illustrates a collapsed view of the assembled baton of FIG. 1.

As previously described in FIG. 3, end 121 of solid striking rod 130 is separated from the retention magnet 140 by a distance 325, while the baton 300 is in the collapsed position. The compression shown in FIG. 5, enables an expanded baton 100 (as shown in FIG. 2) to shrink to a reduced size. An example of this is illustrated in FIG. 6, which shows a collapsed assembled baton 100. The baton 100 is collapsed such that both the middle tube 125 and the striking rod 130 are encapsulated within the end cap 105 and the handle tube 110; and the striking tip 135 comes into contact with the handle tube 110. In one embodiment, this collapsed position, the baton's 100 most compressed size, which may be a reduction of a factor of 2-3 times its size while fully expanded.

Figure 7:
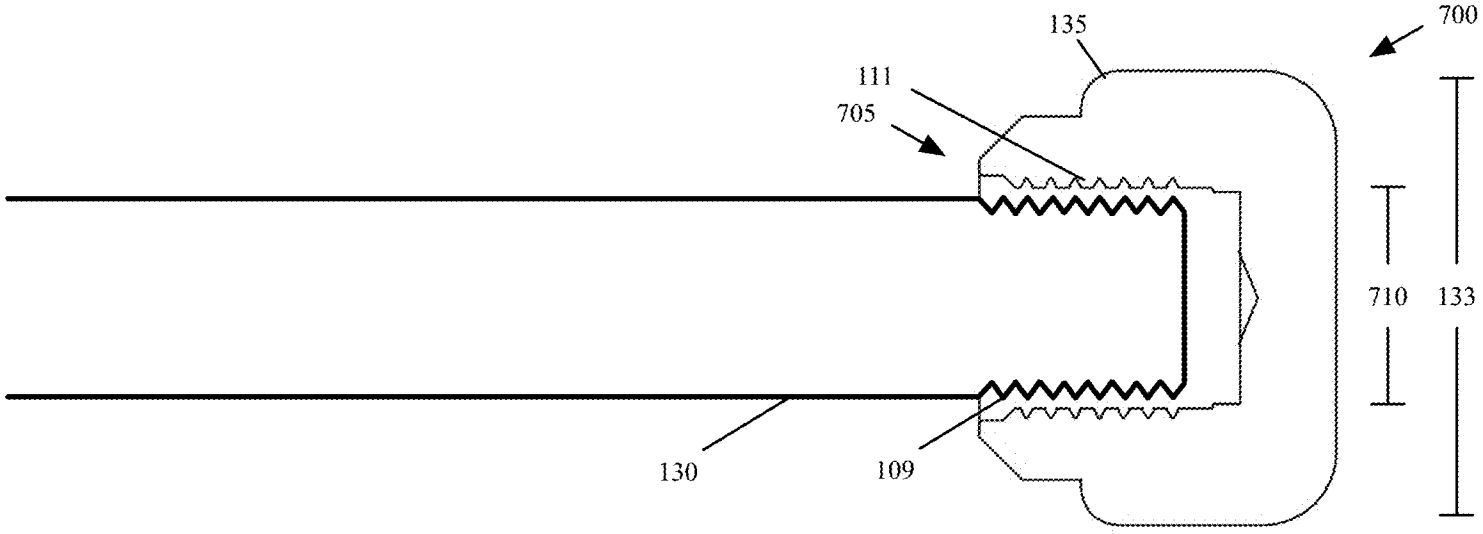
FIG. 7 illustrates a schematic cross-sectional view of the striking rod and the striking tip, while they are attached together.

FIG. 7 illustrates a schematic cross-sectional view of the striking tip 135 attached to the solid striking rod 130. As described in FIG. 1, striking tip 135 fastens to the solid striking rod 130 through the use of threaded portions. In particular, an external thread 109 of the solid striking rod 130 threads into a first end 705 of the striking tip 135 having an internal thread 111 of the striking tip 135. By threading the solid striking rod 130 into the striking tip 135, the connection between the striking tip and striking rod is secure and less prone to bending. The striking tip 135 also has a distal end 700 (e.g., a second end) that is flat and with a smooth surface. In one embodiment, the striking tip 135 is spherical in design and has a larger diameter than the striking rod 130, thereby creating more surface area for which to strike a target. For instance, the distal end 700 of the striking tip 135 may be spherical, such that the first end 705 has a first diameter 710 that is smaller than the diameter 133 (e.g., a second diameter) of the distal end 700. Having a spherical design with a larger surface area (e.g., at the distal end 700) than the striking rod 130 allows a user to focus more energy at a target in which the user is striking. In another embodiment, the striking tip 135 has rounded and/or no sharp corners (e.g., protruding edges that meet at 90 degrees from each other) in order to avoid objects (e.g., clothing) from getting caught on the baton 100 while it is in use. As such, the first end 705 of the striking tip 135 may smoothly transition to the distal end 700 of the striking tip.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the expandable baton 100 disclosed herein is described as having three shafts (a handle tube, a middle tube, and a striking rod), the expandable baton may instead just have two shafts (a handle tube and a striking rod). In this case, both designs would be similar, but rather than having two collars in the end cap, the baton with only two shafts would have only one corresponding collar.

What is claimed is:

1. An expandable baton comprising:

a handle tube having a proximal end, a distal end, and a channel extending between the proximal end and the distal end;

a striking rod dimensioned to slide within the channel and having a retention end; and an end cap attached to the proximal end of the handle tube, the end cap comprises a well chamber with (1) a retention magnet that is configured to attract the striking rod and (2) a collar that is separated from the retention magnet by a predetermined distance, wherein the retention end of the striking rod is configured to abut the collar when the striking rod is within the channel.

2. The expandable baton of claim 1, wherein the predetermined distance is between 0.005 inches and 0.08 inches.

3. The expandable baton of claim 1, wherein the retention magnet comprises a pull force measurement of between at least one of 14-18 lbs. and 19-22 lbs.

4. The expandable baton of claim 1, wherein the well chamber comprises a first diameter and the retention end of the striking rod comprises a second diameter that is more than the first diameter, such that while the striking rod is within the channel, the striking rod can not enter the well chamber.

5. The expandable baton of claim 1, wherein the channel is a first channel, wherein the expandable baton further comprises a middle tube having a second channel, wherein the middle tube is (1) dimensioned to slide within the first channel of the handle tube and (2) configured to house the striking rod.

6. The expandable baton of claim 5, wherein the collar is a first collar and the end cap further comprises a second collar, wherein the proximal end is a first proximal end, the middle tube further comprises a second proximal end that is configured to abut the second collar when the striking rod is within the second channel.

7. The expandable baton of claim 6, wherein the second collar has a tapering hollow portion that tapers from the second collar towards the first collar, such that first collar has a first diameter and the second collar has a second diameter that is larger than the first diameter.

8. The expandable baton of claim 1, wherein the striking rod is a solid striking rod.

9. The expandable baton of claim 8, wherein the solid striking rod is composed of a metallic alloy comprising a ferrous metal.

10. The expandable baton of claim 8, wherein the solid striking rod has a striking end comprising an external thread, wherein the expandable baton further comprises a striking tip comprising an internal thread, wherein the striking tip is configured to fasten to the striking end of the solid striking rod through tightening the internal thread of the striking tip onto the external thread of the solid striking rod.

11. The expandable baton of claim 1, wherein the handle tube is between 1.0625 inches and 1.1875 inches in diameter.

12. An expandable baton comprising:

a handle tube having a first end, a second end, and a channel extending between the first end and the second end;

a middle tube having a hollow interior, a first portion positioned within the channel of the handle tube and a second portion extending from the second end of the handle tube;

a solid striking rod having a first portion positioned within the hollow interior of the middle tube and a second portion extending from the second portion of the middle tube, the second portion of the striking rod having an exterior thread along its outer surface;

a striking tip having an interior thread complementary to that of the exterior thread of the striking rod, wherein such that the striking tip attaches to and envelopes the second portion of the striking rod; and an end cap attached to the first end of the handle tube, wherein the end cap comprises a retention structure that is configured to retain the middle tube and the solid striking rod within the channel of the handle tube when the expandable baton is in a collapsed configuration.

13. The expandable baton of claim 12, wherein the striking tip comprises a first end having the interior thread and a second end, opposite from the first end, having a flat surface, wherein the first end has a first diameter and the second end has a second diameter that is larger than the first.

14. The expandable baton of claim 13, wherein the first end of the striking tip smoothly transitions to the second end of the striking tip, such that the striking tip does not include any sharp edges.

15. The expandable baton of claim 12, wherein the retention structure comprises a well chamber with (1) a retention magnet that is configured to attract the striking rod and (2) a collar that is separated from the retention magnet by a predetermined distance, wherein a portion of the striking rod is configured to abut the collar when the expandable baton is in the collapsed position.

16. The expandable baton of claim 15, wherein the particular distance is between 0.005 inches and 0.08 inches.

17. The expandable baton of claim 15, wherein the collar is a first collar and the end cap further comprises a second collar, wherein the first portion of the middle tube is configured to abut the second collar when the expandable baton is in the collapsed position.

18. An expandable baton comprising:

a handle tube with a proximal end, a distal end, and a first channel extending between the proximal end and the distal end;

a middle tube having a hollow interior, a first portion within the channel and a second portion extending from the distal end of the handle tube;

a solid striking rod, wherein at least a portion of the solid striking rod is within the hollow interior of the middle tube; and an end cap attached to the proximal end of the handle tube, wherein the end cap comprises a retention structure that is configured to retain a collapsed position of the expandable baton, such that there is a separation between the retention structure and the solid striking rod.

19. The expandable baton of claim 18, wherein the retention structure comprises a well chamber with (1) a retention magnet that is configured to attract the solid striking rod and (2) a collar that is configured to (i) receive the portion of the solid striking rod and (ii) hold the portion solid striking rod, while the rod is being attracted by the retention magnet.

20. The expandable baton of claim 19, wherein the collar is above the retention magnet by a particular distance in order to create the separation.

21. The expandable baton of claim 18, wherein the proximal end is a first proximal end and the solid striking rod comprises an exterior threaded portion, wherein the expandable baton further comprises a striking tip with an interior threaded portion that is complementary to that of the exterior threaded portion of the striking rod, such that the striking tip attaches to and envelopes the exterior threaded portion of the striking rod.

* * * * *